US006062059A

United States Patent [19]

Feldcamp

[11] Patent Number: 6,062,059

[45] Date of Patent: May 16, 2000

[54] MANUFACTURE OF EXTRUSION DIES

[75] Inventor: Edward George Feldcamp, Tewkesbury, United Kingdom

[73] Assignee: Ailsa Investments Limited, Douglas, United Kingdom

[21] Appl. No.: 08/983,118

[22] PCT Filed: Jul. 4, 1996

[86] PCT No.: PCT/GB96/01595

§ 371 Date: Feb. 4, 1998

§ 102(e) Date: Feb. 4, 1998

[87] PCT Pub. No.: WO97/02910

PCT Pub. Date: Jan. 30, 1997

[30] Foreign Application Priority Data

Jul. 7, 1995 [GB] United Kingdom ..... 9513885

[51] Int. Cl.[7] ..... B21C 31/00

[52] U.S. Cl. ..... 72/271; 72/269; 72/467; 76/107.4

[58] Field of Search ..... 72/260, 269, 271, 72/467; 76/107.1, 107.4

[56] References Cited

U.S. PATENT DOCUMENTS

| | | | |
|---|---|---|---|
| 2,671,559 | 3/1954 | Rosencratz | 72/253.1 |
| 2,894,625 | 7/1959 | Harris et al. | 72/467 |
| 2,968,835 | 1/1961 | Weston, Jr. et al. | 72/467 |
| 3,014,583 | 12/1961 | Huffman et al. | 72/467 |
| 3,782,164 | 1/1974 | Felker | 72/467 |
| 3,973,428 | 8/1976 | Lugosi | 72/467 |
| 5,095,734 | 3/1992 | Asher | 72/260 |
| 5,756,016 | 5/1998 | Huang et al. | 72/271 |
| 5,870,922 | 2/1999 | Rodriguez | 72/271 |

*Primary Examiner*—Ed Tolan
*Attorney, Agent, or Firm*—Young & Thompson

[57] ABSTRACT

An extrusion die (11) comprises a die cavity (12) having a shape corresponding to the cross-sectional shape of the required extrusion, and a preform chamber (19) in communication with the die cavity (12), the preform chamber (19) being of generally similar shape to the die cavity (12) but of greater cross-sectional area, so that regions of the preform chamber (19) communicate with corresponding regions respectively of the die cavity (12). Each region of the preform chamber (19) has a bearing length (20) which is so determined in relation to its dimensions and position that, in use, extrusion material passing through each region of the preform chamber (19) is constrained to move at a velocity such that the material passes through all regions of the die cavity (12) at a substantially uniform velocity. The die cavity (12) itself is of uniform, preferably zero, bearing length so that the extrusion process is controlled solely by adjustment of the preform chamber (19), such adjustment then being readily quantifiable and repeatable.

26 Claims, 5 Drawing Sheets

Figure 4:
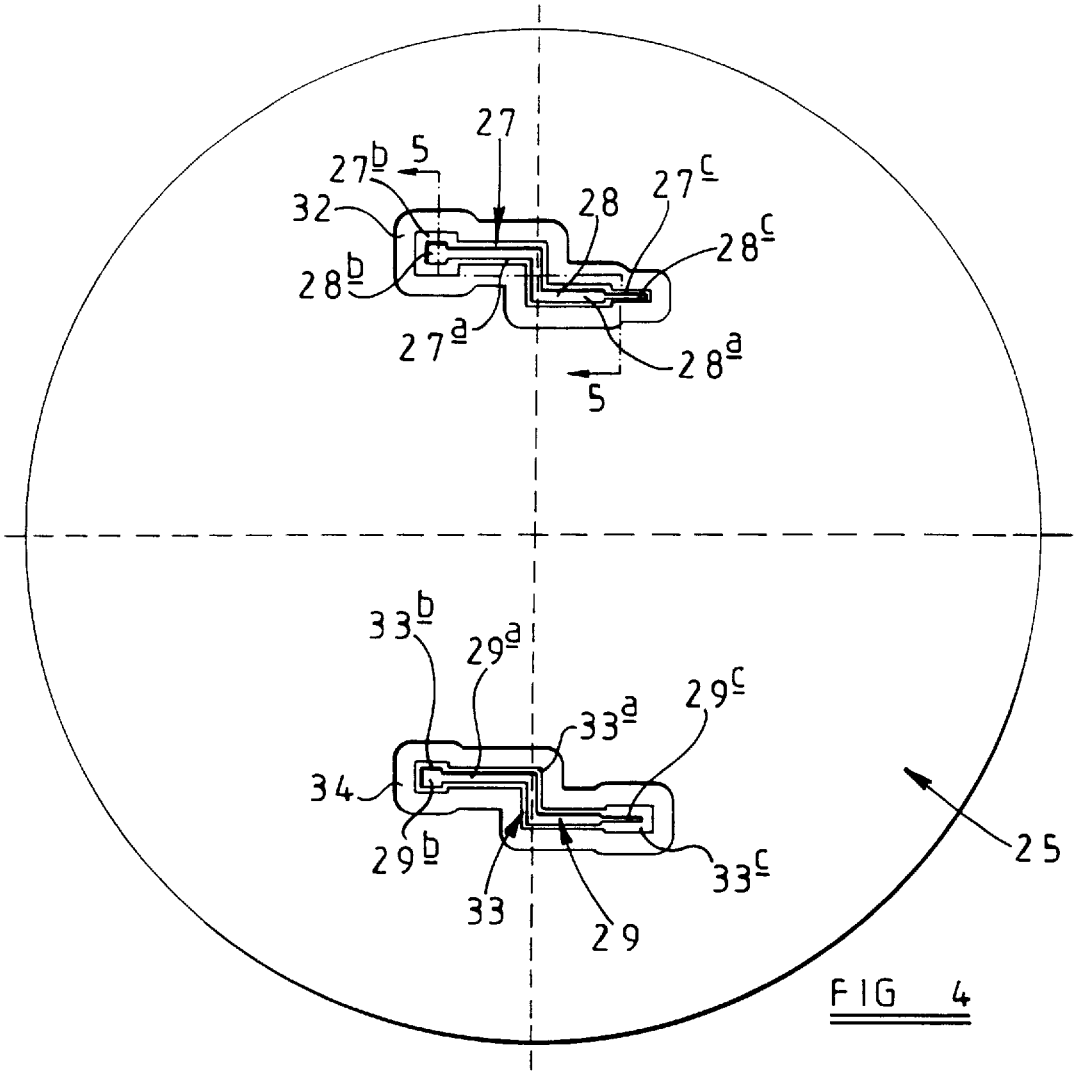

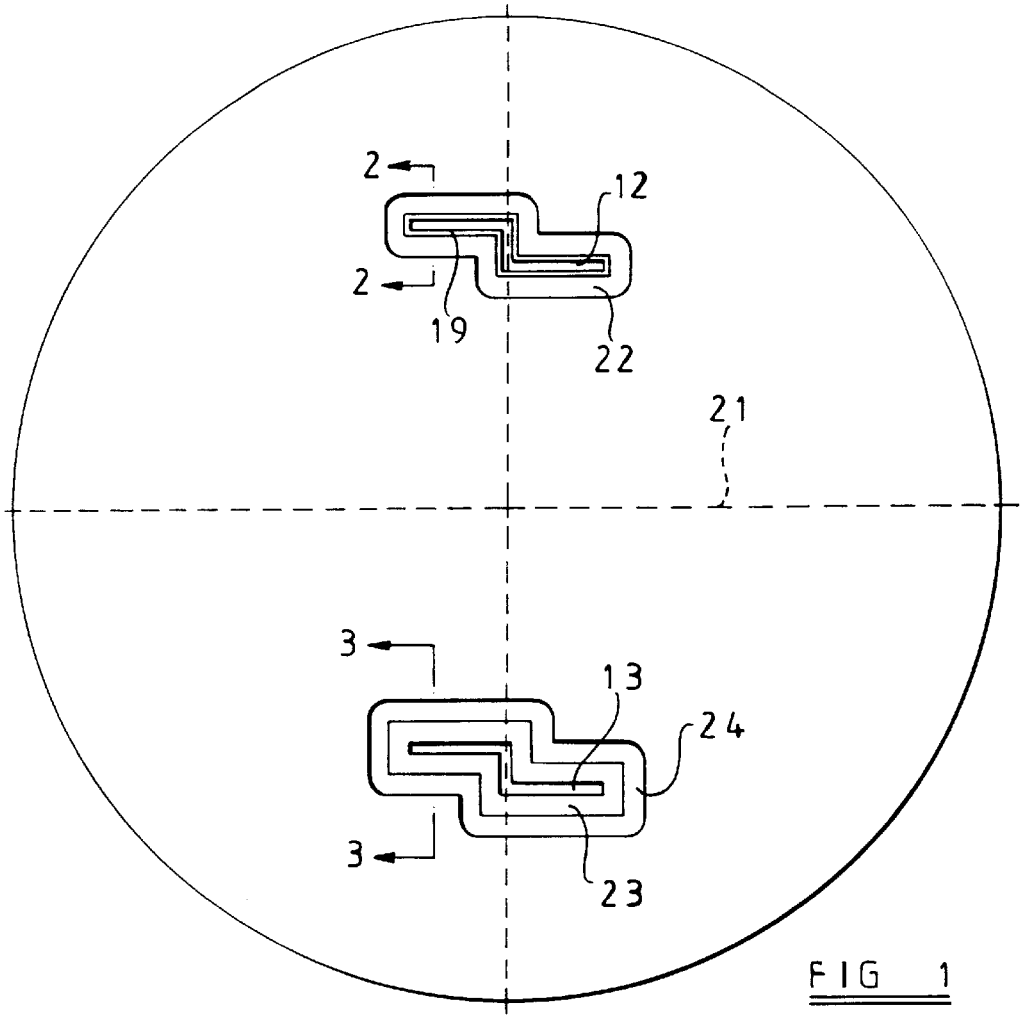
FIG 1
FIG 2
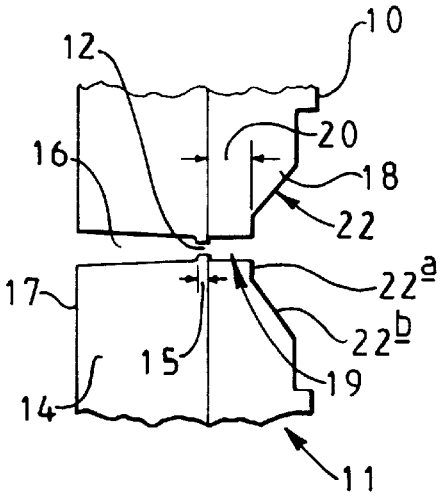
FIG 3
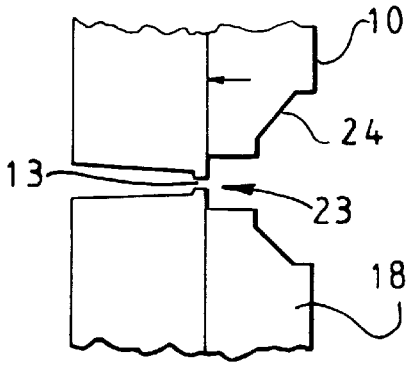

MANUFACTURE OF EXTRUSION DIES

This application is a 371 of PCT/GB96/01595 filed Jul. 4, 1996.

The invention relates to extrusion dies used for producing elongate profiles in metal (such as aluminium) plastics etc. In an extrusion process it is necessary for all parts of the material being extruded to pass through the die at substantially the same velocity, since if this is not the case the extruded profile is likely to be deformed.

As is well known, in an extrusion die the velocity of the extrusion material through the die, at any particular region of the die cavity, depends on the width of the die cavity in that region, its position relative to the centre of the die, and the bearing length of the die cavity (i.e. its length in the extrusion direction) in that region.

Since the width and position of each region of the die cavity are essentially determined for any particular profile to be extruded, it is normally necessary to control the velocity by adjusting the bearing length of the die cavity in different regions thereof so that the velocity of extrusion material is as uniform as possible through the whole area of the die cavity. Thus, a narrow part of the die cavity will require a shorter bearing length than a wider part of the cavity in order to achieve the same velocity.

This required variation in bearing length (known as the bearing contour) is normally achieved by forming in the back face of the die, i.e. the face furthest from the billet of material to be extruded through the die, an exit cavity which corresponds to the general shape of the die cavity plus an all-round clearance. The depth of the exit cavity is then varied so as to adjust the effective bearing length of the die cavity itself.

Various methods of this kind for manufacturing an extrusion die are described, for example, in British Patent Specifications Nos. 2143445 and 2184371.

There are numerous well known methods and techniques for providing the required correlation between bearing length and die cavity shape and position in order to achieve uniform flow. For example, the required bearing lengths may be achieved by trial-and-error methods based on the knowledge of an experienced die designer or, increasingly, computer programs are available to calculate required bearing lengths from the shape and position of the die cavity.

However, the extrusion dies resulting from such prior art methods may suffer from certain disadvantages. For example, the surface of the extruded profile may be longitudinally marked by a part of the die cavity where there are two adjoining regions of significantly different bearing lengths, as may frequently occur. Furthermore, since the die cavity itself has to be worked on and adjusted to control the flow of extrusion material, it may not be possible to form the die from a material which cannot be readily worked, or to provide it with a surface finish, such as nitriding, which might otherwise be desirable to give a better finish to the profile. It would therefore be desirable to achieve substantially uniform flow through a die cavity which has a substantially uniform, fixed bearing length so as to avoid marking of the profile due to changes in bearing lengths and to allow the die to be formed from a material, and have a surface finish, to give the best possible strength and wear resistance as well as to provide the finest possible finish on the extruded profile.

One method of achieving such an effect is described in European Patent Specification No. 0569315. In the method described in that specification, there is provided on the front, or entry, side of the die cavity an enlarged entry cavity the sides of which converge as they extend towards the cavity in the extrusion direction so as to provide an "entry angle". This "entry angle" is calculated in reciprocal ratio with the width of each region of the die cavity. Selection of different entry angles to different regions of the die cavity thus controls the velocity of extrusion material towards the die cavity in such manner that, at the entry to the die cavity, the velocity of the extrusion material at each region is such as to result in a substantially uniform velocity through the whole area of the die cavity. Accordingly, the die cavity itself may be of substantially constant bearing length. In a preferred embodiment the entry angle is provided by forming the entry cavity with a series of steps extending inwardly towards the die cavity. The steps are of constant depth and the entry angle is adjusted by varying the width of the steps.

While such arrangement has met with some success, it may suffer from certain disadvantages. For example, where the die cavity is formed with sections which are closely spaced from one another there may be insufficient room on the entry side of each section to provide separate and individual entry angles for each region, since the adjacent stepped entry cavities would overlap. Consequently, in practice such closely adjacent sections of the die cavity have to communicate with a single stepped entry cavity. This means that there is no individual control over flow through these adjacent regions of the die cavity and this may result in non-uniform flow through the regions if they are of different widths. Furthermore, the adjustment of the flow rate by adjustment of the entry angle does not make use of the long established and well known techniques for controlling velocity by adjusting bearing length, with the result that die designers must learn entirely new, and unfamiliar, techniques and parameters in order to put the system into operation.

Also, although the "entry angle" may be calculated for each region of the die cavity, it is in practice also necessary to make minor adjustments in order to correct variations in velocity which may show up in initial testing of the die. Such minor adjustments may be effected by adjusting the bearing length of the die cavity in a particular region, but this loses the advantage of having a die cavity of substantially constant bearing length. However, it may be difficult to make accurate minor adjustments to the entry angle which is the only other means for varying the velocity through a region of the die. This is presumably why the stepped arrangement is preferred since it may be easier to adjust the width of a series of steps than it is to accurately adjust the angle of a continuous inclined surface. However, the provision of the steps may provide considerable resistance to the flow of material into the die cavity with the result that the overall velocity of the extrusion material through the die is reduced. This is undesirable since the productivity of an extrusion installation depends on the speed with which extrusions are produced. Also, the stepped arrangement may cause the generation of excessive heat.

It is also known to provide a lead-in plate on the front side of the die, provided with apertures which communicate with the die cavities. However, such lead-in plates are generally of constant thickness and the velocity of extrusion material passing through the apertures in the lead-in plate may only be adjusted by adjusting the width of such apertures. This is not sufficiently precise to provide accurate velocity control, and conventional correction of the die cavity itself is also required. For continuous extrusion it is also common practice to provide a weld plate on the front side of the die. In this case the trailing end of each metal billet is sheared off at the front surface of the weld plate and is engaged by the leading surface of a new billet which becomes welded to the end of the previous billet as the junction between the two billets passes through the weld plate. However, again, the weld plate is not used to control the flow of metal precisely, and correction of the die cavity itself is still required.

The present invention sets out to provide improved forms of extrusion die, and methods of manufacture of such dies, which may overcome many or all of the above-mentioned disadvantages of the prior art systems and in a preferred embodiment, provides a fully controlled system where no correction of the die cavity itself is required.

According to the invention there is provided an extrusion die comprising a die cavity having a shape corresponding to the cross-sectional shape of the required extrusion, and a preform chamber in communication with the die cavity, the preform chamber being of generally similar shape to the die cavity but of greater cross-sectional area, so that regions of the preform chamber communicate with corresponding regions respectively of the die cavity, each region of the preform chamber having a bearing length which is related to the dimensions and position of said region so that, in use, extrusion material passing through each region of the preform chamber is constrained to move at a velocity such that the material passes through all regions of the die cavity at a substantially uniform velocity.

Since the velocity of the extrusion material is fully controlled in the preform chamber, i.e. before it reaches the die cavity, the die cavity itself may be of constant bearing length in all regions thereof, with the advantages referred to above. The velocity of metal through the preform chamber is adjusted by adjusting the width and bearing length of the preform chamber. This enables the wealth of experience and/or computer programs already used in the designing of conventional die cavities to be employed, resulting in accurate control of the velocity. Furthermore, since no "entry angle" is required, the side walls of the preform chamber may be parallel or substantially parallel, so that the maximum width of the preform chamber may be significantly less than the maximum width of the entry cavity in the prior art "entry angle" arrangement referred to above, with the result that there is room to provide a separate region of the preform chamber for each region of the die cavity. If two regions of the die cavity are particularly closely spaced, the enlarged preform chamber communicating with each region may be made correspondingly narrow, the velocity being controlled by reducing the bearing length of the preform chamber. Alternatively, if the shape of the die cavity permits this, the regions of the preform chamber may be offset relative to their corresponding regions of the die cavity so that they do not interfere with one another, while remaining in communication with their corresponding regions of the die cavity.

To provide precise control of the flow through the preform chamber, the side walls of the chamber are preferably exactly parallel.

By appropriate selection of the width of the different regions of the preform chamber, the number of regions of the preform chamber requiring a different bearing length may be reduced. This allows the number of variable parameters for controlling the flow of metal through the die aperture to be reduced thus simplifying correction of the die and rendering such correction more repeatable and reliable.

As mentioned above, variations in velocity can cause the extruded profile to be deformed and varying the bearing length within the die cavity itself can lead to surface marking of the profile. The present invention may therefore achieve the production of high quality profiles. Equally importantly however, the invention enables the manufacturing process itself to be controlled and improved. For example, an extrusion die will normally incorporate a number of similar die cavities spaced apart over the face of the die, so as to produce several extruded profiles simultaneously. As they are extruded, the profiles are drawn by a single puller device. Accordingly, it is necessary for the profiles from all of the die cavities to be extruded at the same speed since otherwise the puller device may stretch and thus deform any of the profiles which are being extruded at a slightly slower speed than the rest. Since the present invention allows the speeds of extrusion to be controlled very accurately it becomes possible to unify the speeds of extrusion from the various die cavities in the die. The invention also allows the overall velocity of extrusion to be increased, as will be described, thus allowing the productivity of the die to be increased in a reliable and controlled manner.

Since the velocity through each region of the die cavity is controlled in the preform chamber before the die cavity is reached, the die cavity will produce an extruded profile which is of exactly the same shape as the die cavity and it is not necessary, as has hitherto been the case, to build deformations into the die cavity in order to correct the profile of the extrusion emerging from it. For example, with conventional methods it is frequently necessary, for some shapes of profile, to incline the walls of the bearing portion of the die cavity in one direction or another in order to compensate for some deficiency in the shape of the profile which becomes apparent in testing. Also, for example, where two portions of a profile are required to be at a specified angle to one another, it may be necessary for the corresponding portions of the die cavity to be at a slightly different angle in order to achieve the required angle in the extruded profile. Some of these adjustments in the shape of the die aperture may be very slight and may be lost or diminished if the die is not carefully and properly maintained over a prolonged period of use. Thus, cleaning and polishing of the die aperture can, over time, remove slight correctional variations in the shape of the die aperture so that although the die produces the correct profile when new, it changes with use to begin to produce a slightly deformed profile. This problem does not arise with the present invention where the control of the metal flow is effected before the metal reaches the die aperture. This sort of deliberate deformation of the die cavity can be avoided with the present invention where the extrusion material is fully controlled in the preform chamber before it reaches the die cavity and may be so controlled that the extruded profile produced by the die cavity is exactly in accordance with the shape of the die cavity itself.

The alterations and corrections which a conventional die corrector may make to a die, in order to achieve the desired profile, may be slight and subtle, being based on the die corrector's long experience and often being intuitive. Such corrections may therefore be difficult or impossible to record and to repeat reliably over a succession of similar dies. By contrast, in the present invention the desired profile is achieved by adjusting a few clearly-defined parameters of the preform chamber. These parameters may be measured and recorded, for example in a computer program, and repeated continually, by precise machine methods, in a succession of dies to give entirely consistent results. Conventional die correction may require much hand work, which is inherently difficult to repeat precisely. The present invention may allow all shaping of the preform chamber and die cavity to be carried out by machine, so as to be inherently repeatable.

As mentioned above, the die cavity may be of substantially constant bearing length in all regions thereof. In particular, the invention allows all regions of the die cavity to be of substantially zero bearing length.

It is known to provide extrusion dies of zero bearing length, and for example such dies are described in European Patent Specification No. 0186340. However, as acknowledged in that specification, the design of a conventional zero bearing length die is such that modification of the profile of the aperture to hasten or slow the passage of metal is not possible. Accordingly, zero bearing length dies have hitherto been regarded as mainly suitable for extruding the minority of sections whose configuration does not require adjustment or correction. If a conventional zero bearing length die does not produce an extrusion of the required profile, there is no way in which the die can be corrected. However, since the present invention allows control of the velocity of the metal upstream of the die, it allows the use of zero bearing length dies for virtually all types of section. Thus, the present invention allows the advantages of zero bearing length dies to be combined with reliable correction and control.

A die cavity of substantially zero bearing length may be formed by providing in the die plate a die aperture which is negatively tapered throughout its length, i.e. the walls of the die aperture diverge as they extend from the front surface to the back surface of the die plate. As mentioned in EP 0186340 a negative taper angle of at least 0.8°0 is preferred so that any friction stress between the walls of the die and metal flowing through it is negligible. It is believed that a negative taper angle of about 1.5° is more reliable.

It will be appreciated that it is in practice impossible to provide a die cavity which is literally of zero bearing length, since there will normally be a small radius at the junction between the negatively tapered die cavity and the front surface of the die plate. EP 0186340 relates to arrangements where this radius of curvature is not greater than 0.2 mm. However, for the purposes of this specification the die cavity is regarded as having zero bearing length where the die cavity increases in width as it extends away from the front face of the die plate, regardless of the radius of curvature at the upstream end of the die cavity.

In any of the arrangements according to the invention the region of the preform chamber which is of minimum bearing length may also be of substantially zero bearing length, increasing to a maximum the overall velocity of extrusion.

At least some of said regions of the preform chamber may each have a width which is the same predetermined percentage greater than the width of the respective corresponding region of the die cavity. Alternatively or additionally, at least some of said regions of the preform chamber may each have a width which is greater than the width of the respective corresponding region of the die cavity by the same predetermined amount.

The width of said regions of the preform chamber are preferably substantially symmetrically disposed in relation to the width of the corresponding region of the die cavity. However, as previously mentioned, the width of one or more of said regions of the preform chamber may be offset in relation to the width of the corresponding region of the die cavity.

Preferably the bearing length of each region of the preform chamber is provided by a bearing part thereof which is immediately adjacent the corresponding region of the die cavity.

Each region of the preform chamber may include a part which is upstream of the bearing part which provides the bearing length, and which increases in width as it extends away from said bearing part.

The die cavity and preform chamber are preferably formed in separate components which are clamped together with the preform chamber in communication with the die cavity. Alternatively the die cavity and preform chamber may be integrally formed in a single component. However, an advantage of forming the preform chamber and die cavity in separate components is that it may allow the preform chamber component to be re-used with a new die cavity component should the original die cavity component wear out.

The invention also includes within its scope a method of manufacturing an extrusion die comprising forming the die with a die cavity having a shape corresponding to the cross-sectional shape of the required extrusion, and a preform chamber in communication with the die cavity, the preform chamber being of generally similar shape to the die cavity but of greater cross-sectional area, so that regions of the preform chamber communicate with corresponding regions respectively of the die cavity, and adjusting the bearing lengths of different regions of the preform chamber in relation to the dimensions and position of those regions so that, in use, extrusion material passing through each region of the preform chamber is constrained to move at a velocity such that the material passes through all regions of the die cavity at a substantially uniform velocity.

Figure 5:
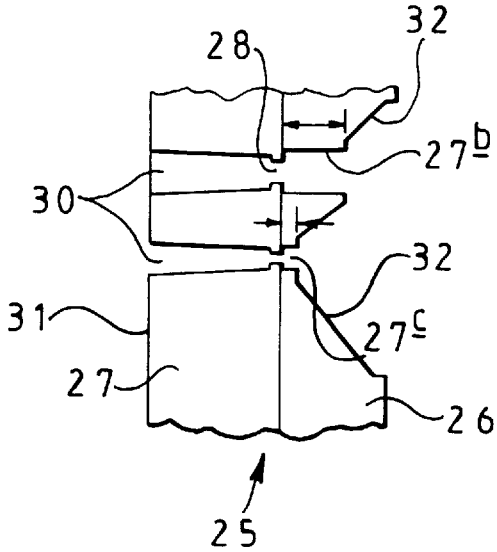
Figure 6:
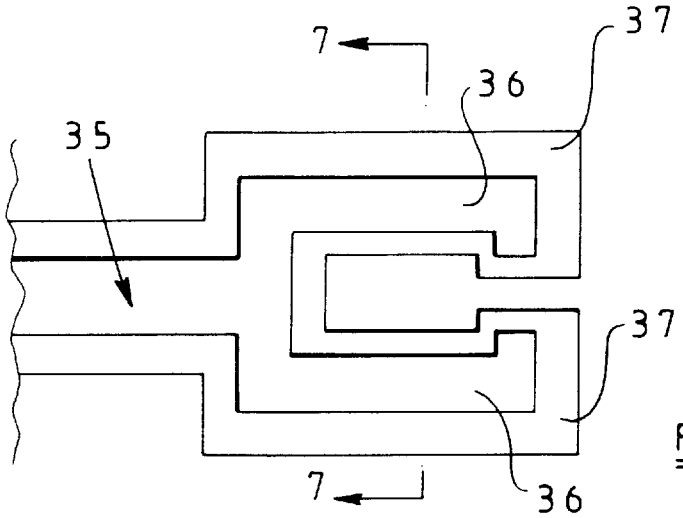
Figure 7:
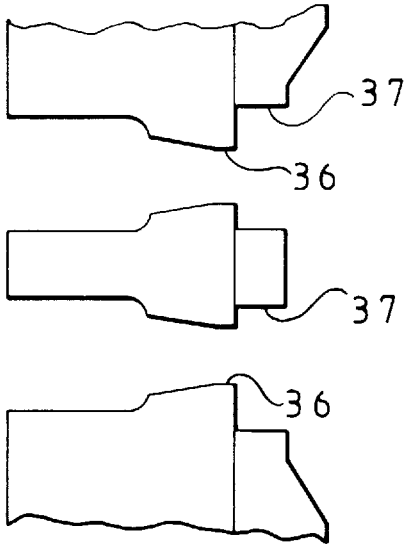
Figure 8:
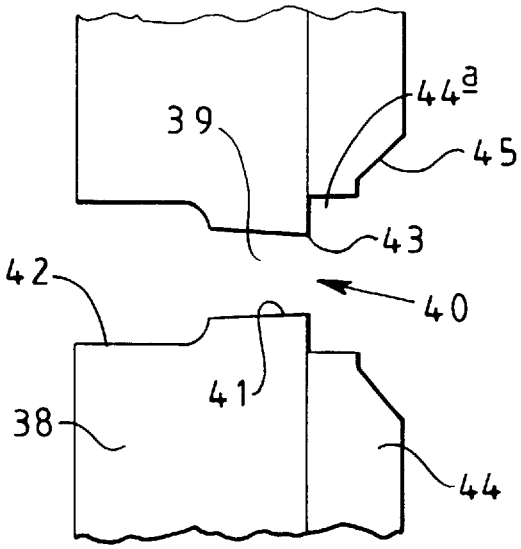
Figure 9:
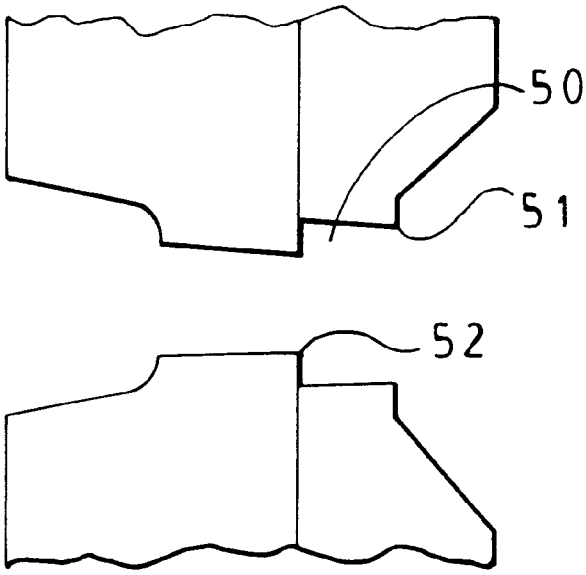
Figure 10:
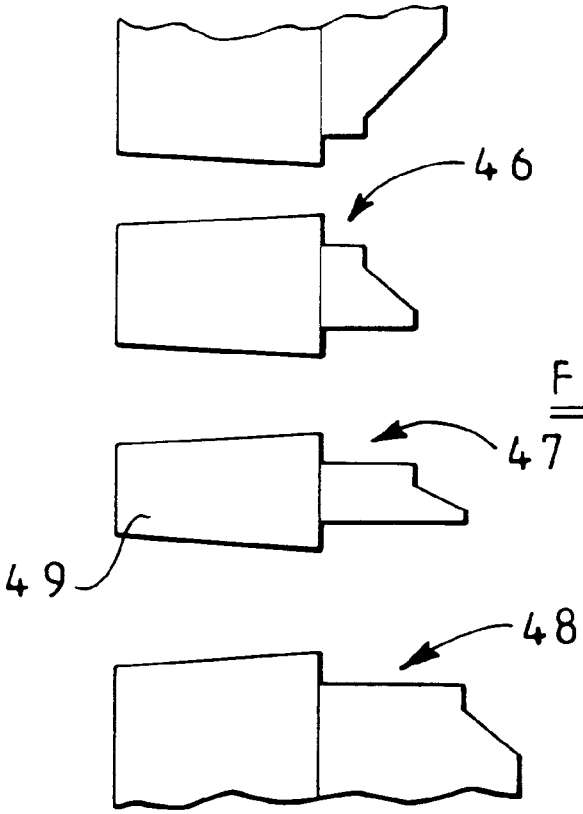
Figure 11:
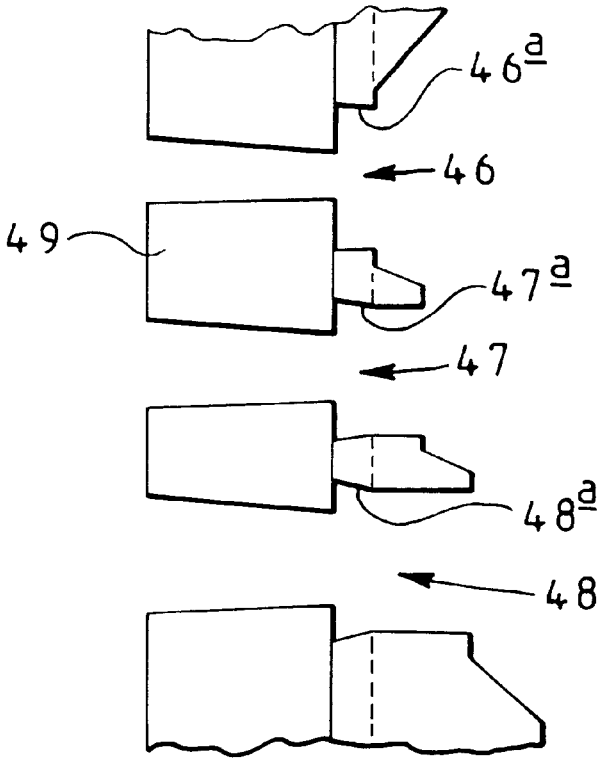
Figure 12:
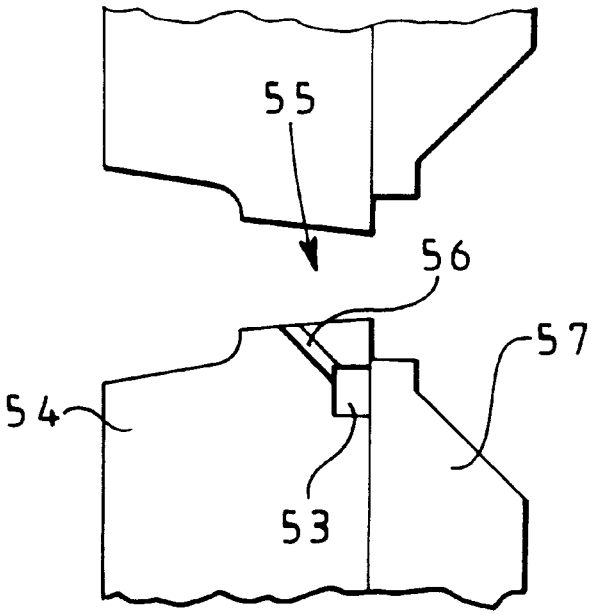

The following is a more detailed description of embodiments of the invention, by way of example, reference being made to the accompanying drawings in which:

FIG. 1 is a diagrammatic front face view of an extrusion die formed with two simple cavities, FIG. 2 is a diagrammatic section on the Line 2—2 of FIG. 1, FIG. 3 is a diagrammatic section on the Line 3—3 of FIG. 1, FIG. 4 is a front face view of an extrusion die showing two die cavities of slightly more complex form than FIG. 1, FIG. 5 is a section on the Line 5—5 of FIG. 1, FIG. 6 is a diagrammatic front face view of part of a further form of die cavity, FIG. 7 is a diagrammatic section on the line 7—7 of FIG. 6, FIG. 8 is a diagrammatic section through a die having a die cavity of zero bearing length, FIG. 9 is a diagrammatic section through another form of die, FIG. 10 is a diagrammatic section through a further form of die, FIG. 11 is a similar view of a modified version of the cavity of FIG. 10, and FIG. 12 is a diagrammatic section through a die cavity incorporating cooling.

FIG. 1 shows the front face 10 of an extrusion die 11 formed with two cavities 12 and 13 of generally flattened Z-shape.

In a conventional prior art construction each die cavity 12 or 13 would communicate with an enlarged divergent exit cavity formed in the back face of the die plate. The bearing length of different regions of the die cavity, i.e. its dimension in the direction of extrusion, would be adjusted by adjusting the depth of this exit cavity. By this means the bearing length of each part of the die cavity would be adjusted in a manner to result in a substantially uniform velocity of the extrusion material through all parts of the die cavity.

By contrast, in accordance with the present invention, the front face of the die is formed with a preform chamber through which the extrusion material is forced before it reaches the die cavity 12 or 13, thus enabling the velocity of the extrusion material to be adjusted before it reaches the die cavity itself.

Referring to FIG. 2 it will be seen that the die 11 comprises a back plate 14 in which the die cavity 12 itself is formed. All parts of the die cavity 12 have a constant bearing length 15 which may, for example, be 2 mm. An exit cavity 16 leads from the die cavity 12, the walls of the cavity diverging as they extend to the back face 17 of the die plate 14.

Clamped rigidly to the back plate 14 is a front plate 18 which is formed with a preform chamber 19. The preform chamber is generally similar in shape to the die cavity 12 but the width of all regions of the preform chamber is greater than the width of the corresponding regions of the die cavity 12. As may be seen from FIG. 1, in the case of the upper die cavity 12 the preform chamber 19 has a width which is increased by 50% all around the die cavity 12 so that the overall width of each region of the preform chamber 19 is twice the overall width of the corresponding region of the die cavity. Such arrangement will be referred to as a "50% growth" arrangement.

In accordance with the present invention the bearing length 20 (see FIG. 2) of each region of the preform chamber 19 is calculated in accordance with the width of the preform chamber in that region, and in accordance with its distance from the centreline 21 of the die, to give a required velocity of extrusion material as it enters the die cavity itself. The velocity at entry to each region of the die cavity is selected such that the rate of subsequent flow through all regions of the die cavity is substantially uniform. The bearing length 20 of the preform chamber is controlled by milling into the front face 10 of the front plate 18 an entry cavity 22 of appropriate depth to give the required resultant bearing length 20 to the preform chamber 19.

The entry cavity 22 comprises a flat narrow shoulder 22*a*, to define the inlet end of the preform chamber 19 exactly, and surfaces 22*b* inclined at approxirnately 45° away from the chamber 19. Such inclination is necessary to ensure that these surfaces do not act as a bearing on the extrusion metal so as to alter the bearing effect of the preform chamber 19.

The use of a preform chamber 19 where the side walls of the preform chamber are parallel enables the velocity to be controlled, by adjusting the bearing length 20, using well established means of calculating the required bearing length to achieve the required velocity. Also, since adjustments to the die to adjust the velocity do not require any alteration to the die cavity 12 itself, as is the case in most prior art methods, the die cavity 12 may be formed in any material to give the required strength and wear resistance without taking into account any necessity of being able to adjust the bearing length of the die cavity after it has been initially formed. Also, since the bearing cavity itself remains unchanged, it may be coated with an appropriate finish, such as by nitriding, so as to give the best possible surface finish to the extruded profile.

Also, since the die cavity 12 itself is of constant bearing length, this also inherently results in a finer finish on the extruded profile, in contrast to the prior art arrangements where the extrusion is likely to be marked where it passes through a region of the die cavity where two different bearing lengths are adjacent one another.

The extent of increase in width, or "growth", of the preform chamber in relation to the die cavity may be of any required value, depending on the size and shape of the die cavity itself and its position in relation to the centreline of the die. By way of example, FIG. 1 also shows a die cavity 13 where the preform chamber 23 exhibits 200% growth, i.e. the increased width of the preform chamber on each side of the die cavity is twice the width of the die cavity 13 itself. Again, an entry cavity 24 is milled into the front face 10 of the front plate 18 of the die, the depth of the entry cavity 24 being selected to give a required bearing length to the preform chamber 23 and hence a required velocity of the extrusion material as it reaches the die cavity 13 itself.

In the case, such as those shown in FIG. 1, where the percentage "growth" of the preform chamber is constant for all regions of the die cavity, the velocity of extrusion material through the preform chamber is controlled solely by adjusting the bearing length of the preform chamber leading to each region. However, in some cases, with more complex profiles, it may be advantageous also to vary the percentage growth of the preform chamber in different regions of the die cavity, and FIGS. 4 and 5 show an example of this.

Referring to FIGS. 4 and 5, the extrusion die 25 again comprises a front plate 26 and a back plate 27. The back plate 27 is formed with two identical die cavities, an upper cavity 28 and a lower cavity 29. Each die cavity has a uniform bearing length of, for example 2 mm, in all regions thereof and leads to an exit cavity 30 which diverges outwardly to the back face 31 of the die.

The front plate 26 is formed with preform chambers 27 and 33 which communicate with the die cavities 28 and 29 respectively and entry cavities 32 and 34 are milled in the front plate 26 to communicate with the die preform chambers respectively.

As best seen in FIG. 4, the two die cavities 28 and 29 are of the same shape, the upper cavity 28 comprising a central region 28*a* of generally flattened Z-shape, an end region 28*b* of greater width than the central region 28*a*, and an opposite end region 28*c* of smaller width than the central region. For example, the central region may have a width of 2 mm, the end region 28*b* a width of 4 mm, and the end region 28*c* a width of 1 mm.

As in the previous arrangement the preform chamber 27 is of generally similar shape to the die cavity 28, and has 50% growth, i.e. the width of the preform chamber, on each side of the die cavity, is increased by 50% of the width of the die cavity.

Also as in the previous arrangement, the bearing lengths of the different regions of the preform chamber 27 are adjusted in relation to the width and position of the regions of the preform chamber, and hence of the regions of the die cavity with which they communicate. Thus, the enlarged region 27*b* of the preform chamber will require a significantly greater bearing length than the region 27*a*, as may be seen from FIG. 5, in order to reduce the velocity to what is appropriate for the larger area of the region of the die cavity, whereas the smaller region 27*c* of the preform chamber will require a smaller bearing length than the region 27*a*.

In some cases finer control of the velocity of the extrusion material may be achieved by also varying the percentage growth of different regions of the preform chamber, in addition to varying their bearing lengths, and such an arrangement is shown in the case of the lower die cavity 29 in FIG. 4. In this case the central region 33*a* of the preform chamber 33 still has 50% growth, but the enlarged end region 33*b* of the preform chamber has only 25% growth. The opposite end region 33*c* of the preform chamber, communicating with the reduced end region 29*c* of the die cavity, has 200% growth.

Looked at another way, the regions 33*a* and 33*b* of the preform chamber may be regarded as having a width which is greater than the width of the respective corresponding regions 29*a* and 29*b* of the die cavity by the same predetermined amount, even though the region 29*b* of the die cavity is wider than the region 29*a*.

The effect of the proportionally reduced growth of the preform chamber region 33*b* is to decrease the velocity of the extrusion material through that region of the preform chamber compared with the velocity through the region 33*a*, so that a shorter bearing length is required in region 33*b* to achieve the required velocity through the region 29*b* of the die cavity. Similarly the increase in width of the region 33*c* of the preform chamber serves to increase the velocity of the extrusion material in a manner appropriate for such a narrow region of the die cavity. This overcomes the possible problem that, with a uniform percentage growth, it may not be possible, by adjustment of the bearing length alone, to achieve sufficient velocity of the extrusion material in the preform chamber 33*c* to ensure that the material passes at the required velocity through the region 29*c* of the die cavity.

In all of the above arrangements according to the invention the provision of a preform chamber corresponding in shape to the die cavity thus provides great flexibility in control over the velocity of the extrusion material through the die to enable the optimum extrusion conditions to be obtained.

It will be appreciated that the simple shapes of die cavity shown are merely by way of example and the invention is applicable to any profile shape. For example, the invention is applicable to extrusion dies for extruding hollow shapes. In this case each preform chamber will be formed partly in the male portion of the die and partly in the female portion so as to provide a preform chamber communicating with the whole of the die cavity.

In the arrangements of FIGS. 1–5 each region of the preform chamber is substantially symmetrical with respect to the corresponding region of the die cavity, that is to say the preform chamber region overlaps the die cavity region by a similar amount on each side. However, this is not essential and in some configurations of die cavity certain regions of the cavity may be so close together that symmetrically disposed regions of the preform chamber would overlap. In such circumstances the regions of the preform chamber may be offset with respect to the corresponding regions of the die cavity so that they do not overlap and may therefore have separate effects on their respective regions of the die cavity. Such an arrangement is shown in FIGS. 6 and 7.

As best seen in FIG. 6, the die cavity 35 is formed at one end to provide two spaced parallel limbs 36. The limbs 36 of the die cavity may be so close that if the corresponding regions 37 of the preform chamber were symmetrically disposed with respect to the regions 36 of the die cavity, they would overlap, thus interfering with the correct controlling effect of the preform chamber. Accordingly, in this case the regions 37 of the preform chamber are offset with respect to their corresponding regions 36 of the die cavity, so as to form two separate and distinct regions. Each region 37 of the preform chamber therefore can be adjusted to control accurately the flow of metal to its corresponding region of the die cavity. The offsetting of the regions of the preform chamber has no significant adverse effect on the operation of the invention. Provided that the preform chambers result in the extrusion metal reaching the die cavity at uniform velocity, it does not matter where the preform chambers are located in relation to the die cavity.

Since the velocity of the extrusion material through a region of the die is increased by reducing the bearing length in that region, the overall velocity of the material through the die may be increased by reducing all bearing lengths. In the majority of conventional extrusion dies it is necessary to retain significant bearing lengths in all regions of the die cavity itself, since differential variation in such bearing lengths is the only way of controlling velocity through the different regions of the die cavity. The present invention, however, allows the use of a die cavity of uniform bearing length. Accordingly, the present invention may be used with a die cavity of so-called zero bearing length, as previously discussed, and one such arrangement is shown in section in FIG. 8.

In this arrangement the die plate 38 is formed with a die cavity 39 having an inlet aperture 40 in the shape of the required extrusion. The walls 41 of the die cavity are negatively tapered, for example at 1.5°, i.e. they diverge slightly as they extend away from the aperture 40. The die plate is cut away at the downstream end of the die cavity 39, in conventional manner, as indicated at 42.

Since the walls 41 are negatively tapered they do not apply any significant frictional restraint to metal passing through the aperture 40 and the metal is shaped solely by the corners 43 around the aperture 40 so that the bearing length of the die cavity is essentially zero. It will be appreciated, however, that the corners 43 require to be smooth so as to provide a good surface finish on the extruded profile. These corners will therefore be slightly radiused so that, in practice, there will be a bearing length which is so small as to be negligible, rather than an actual zero bearing length.

As in all embodiments of the present invention, the velocity of extrusion material through the aperture 40 is controlled by the bearing length of the different regions of the enlarged preform chamber on the upstream side of the die cavity. As previously described, the regions of the preform chamber upstream of the control bearing length 44*a* are tapered outwardly, as indicated at 45 in FIG. 8, so that there is insignificant risk of such parts of the preform chamber plate 44 having any bearing effect on the extrusion material passing through it.

Another way of increasing the overall velocity of material through the die is to reduce as far as possible the bearing lengths of the different regions of the preform chamber.

In all the arrangements previously described, the bearing length portion of each preform chamber region is preferably as close as possible to the die cavity. However, the invention does not exclude arrangements where the bearing lengths of the preform chamber regions are spaced upstream from the corresponding regions of the die cavity. FIG. 9 shows an arrangement where the preform chamber region 50 has a zero bearing length aperture 51 spaced upstream of a zero bearing length die cavity 52. This arrangement minimises the overall bearing length of the die and thus provides for maximum velocity of extrusion material through the die.

In order to retain control of velocity through all regions of the die, only the region of the preform chamber requiring minimum bearing length will be of zero bearing length. However, this will enable the bearing lengths of the other regions to be reduced by a corresponding amount, as will be described with reference to FIGS. 10 and 11.

FIG. 10 shows an arrangement in accordance with the present invention where regions 46, 47 and 48 of the preform chamber are of different bearing lengths, region 46 being of the shortest bearing length. However, the same effect may be achieved by reducing the bearing length of all regions of the preform chamber by an amount equal to the bearing length of the smallest region 46. As shown in FIG. 11, this may be effected by reducing the bearing length of the preform chamber 46 to zero by applying a negative taper to the sides of the chamber as indicated at 46*a*. The bearing lengths of the other preform chambers are reduced by a corresponding amount by negatively tapering a similar length portion thereof, as indicated at 47*a* and 48*a*. Since the bearing lengths of the three regions of the preform chamber have the same relationship, the velocity of the extrusion material as it reaches the die plate 49 is uniform. However, the overall velocity of the material is increased as a result of the reduction in effective bearing length of all regions 46, 47 and 48 of the preform chamber.

In the arrangements described above the die comprises a separate die plate and preform chamber plate, the two plates being clamped together face-to-face. However, in some circumstances it may be desirable and possible to combine the two plates into a single integral plate formed with the appropriate apertures. However, the two-plate arrangement will usually be preferred since it facilitates correction of the bearing lengths in the preform chamber plate and also allows the preform chamber plate to be re-used if the die plate wears out first, which is likely to be the case.

FIG. 12 shows another situation where a two-plate arrangement is to be preferred.

In some circumstances it may be desirable to cool the die and the extrusion material as it passes through the die cavity to reduce the risk of local melting. Cooling of the extrusion material is usually done by injecting a cooled inert gas, usually nitrogen, into the downstream region of the die plate, but cooling of the die itself may be difficult. Two-plate arrangements according to the present invention enable such cooling to be effected in a simple and convenient way, as illustrated diagrammatically in FIG. 12. In this case a main channel 53 is formed in the die plate 54 closely adjacent the die cavity 55 and passages 56 extend laterally from the channel 53 to open into the downstream portion of the die cavity. The preform chamber plate 57 then closes the channel 53. Cooled nitrogen is then pumped under pressure into the channel 53, thereby cooling the die itself, and is fed therefrom along the passages 56 to cool the extrusion material passing through the die cavity.

What is claimed is:

1. An extrusion die comprising a die cavity having a shape corresponding to the cross-sectional shape of the required extrusion, and a preform chamber in communication with the die cavity, the preform chamber being of similar shape to the die cavity but of greater cross-sectional area, so that regions of the preform chamber communicate with corresponding regions respectively of the die cavity and, in use, extrusion material passing through all regions of the die cavity are constrained to move at a substantially uniform velocity, the die cavity including a number of regions of constant bearing length, the preform chamber having different bearing lengths in different regions thereof, and each region of the preform chamber which corresponds to one of said regions of constant bearing length having a bearing length which is related to the dimensions and position of said region of the preform chamber so that, in use, extrusion material passing through each said region of the preform chamber is constrained to move at a velocity such that the material subsequently passes at a uniform velocity through each of said corresponding regions of the die cavity which are of constant bearing length, wherein the bearing length of each region of the preform chamber is provided by a bearing part thereof which is immediately adjacent the corresponding region of the die cavity.

2. An extrusion die according to claim 1, wherein all regions of the die cavity are of constant bearing length.

3. An extrusion die according to claim 1, wherein said regions of the die cavity which are of constant bearing length are of zero bearing length.

4. An extrusion die according to claim 1, wherein a region of the preform chamber which is of minimum bearing length is of zero bearing length.

5. An extrusion die according to claim 1, wherein at least some of said regions of the preform chamber each have a width which is a predetermined percentage greater that the width of the respective correspoding region of the die cavity.

6. An extrusion die according to claim 1, wherein at least some of said regions of the preform chamber each have a width which is greater than the width of the respective corresponding region of the die cavity by the same predetermined amount.

7. An extrusion die according to claim 1, wherein the width of at least one of said regions of the preform chamber is symmetrically disposed in relation to the width of the corresponding region of the die cavity.

8. An extrusion die according to claim 1, wherein the width of at least one of said regions of the preform chamber is offset in relation to the width of the corresponding region of the die cavity.

9. An extrusion die according to claim 1, wherein each region of the preform chamber includes a part which is upstream of a bearing part which provides the bearing length, and which upstream part increases in width as it extends away from said bearing part.

10. An extrusion die according to claim 9, wherein a shoulder is provided at the junction between said bearing part and said upstream part of the preform chamber.

11. An extrusion die according to claim 1, wherein the die cavity and preform chamber are formed in separate components which are clamped together with the preform chamber is communication with the die cavity.

12. An extrusion die according to claim 1, wherein the die cavity and preform chamber are integrally formed in a single component.

13. A method of manufacturing an extrusion die comprising forming the die with a die cavity having a shape corresponding to the cross-sectional shape of the required extrusion, and a preform chamber in communication with the die cavity, the preform chamber being of similar shape to the die cavity but of greater cross-sectional area, so that the regions of the preform chamber communicate with the corresponding regions respectively of the die cavity, each region of the preform chamber having a bearing part which is located immediately adjacent the corresponding region of the die cavity, adjusting the bearing length of the bearing part of different regions of the preform chamber in relation to the dimensions and position of those regions, without altering the bearing lengths of the corresponding regions of the die cavity, so that, in use, extrusion material passing through each region of the preform chamber is constrained to move at a velocity such that the material passes through all regions of the die cavity at a uniform velocity.

14. An extrusion die comprising a die cavity having a shape corresponding to the cross-sectional shape of the required extrusion, and a preform chamber in communication with the die cavity, the preform chamber being of similar shape to the die cavity but of greater cross-sectional area, so that regions of the preform chamber communicate with corresponding regions respectively of the die cavity and, in use, extrusion material passing through all regions of the die cavity are constrained to move at a substantially uniform velocity, the die cavity including a number of regions of constant bearing length, the preform chamber having different bearing lengths in different regions thereof, and each region of the preform chamber which corresponds to one of said regions of constant bearing length having a bearing length which is related to the dimensions and position of said region of the preform chamber so that, in use, extrusion material passing through each said region of the preform chamber is constrained to move at a velocity such that the material subsequently passes at a uniform velocity through each of said corresponding regions of the die cavity which are of constant bearing length, wherein the bearing length of each region of the preform chamber is provided by a bearing part, the bearing parts being located upstream of the die cavity by a uniform distance.

15. An extrusion die comprising a die cavity having a shape corresponding to the cross-sectional shape of the required extrusion, and a preform chamber in communication with the die cavity, the preform chamber being of similar shape to the die cavity but of greater cross-sectional area, so that regions of the preform chamber communicate with corresponding regions respectively of the die cavity and, in use, extrusion material passing through all regions of the die cavity are constrained to move at a substantially uniform velocity, the die cavity including a number of regions of constant bearing length and each region of the preform chamber which corresponds to one of said regions of constant bearing length having a bearing length which is related to the dimensions and position of said region of the preform chamber so that, in use, extrusion material passing through each said region of the preform chamber is constrained to move at a velocity such that the material subsequently passes at a uniform velocity through each of said corresponding regions of the die cavity which are of constant bearing length, wherein the width of at least one of said regions of the preform chamber is offset in relation to the width of the corresponding region of the die cavity.

16. An extrusion die according to claim 15, wherein all regions of the die cavity are of constant bearing length.

17. An extrusion die according to claim 15, wherein said regions of the die cavity which are of constant bearing length are of zero bearing length.

18. An extrusion die according to claim 15, wherein a region of the preform chamber which is of minimum bearing length is of zero bearing length.

19. An extrusion die according to claim 15, wherein at least some of said regions of the preform chamber each have a width which is the same predetermined percentage greater than the width of the respective corresponding region of the die cavity.

20. An extrusion die according to claim 15, wherein at least some of said regions of the preform chamber each have a width which is greater than the width of the respective corresponding region of the die cavity by the same predetermined amount.

21. An extrusion die according to claim 15, wherein the width of at least one of said regions of the preform chamber is symmetrically disposed in relation to the width of the corresponding region of the die cavity.

22. An extrusion die according to claim 15, wherein the bearing length of each region of the preform chamber is provided by a bearing part thereof which is immediately adjacent the corresponding region of the die cavity.

23. An extrusion die according to claim 15, wherein each region of the preform chamber includes a part which is upstream of the bearing part which provides the bearing length, and which upstream part increases in width as it extends away from said bearing part.

24. An extrusion die according to claim 23, wherein a shoulder is provided at the junction between said bearing part and said upstream part of the preform chamber.

25. An extrusion die according to claim 15, wherein the die cavity and preform chamber are formed in separate components which are clamped together with the preform chamber in communication with the die cavity.

26. An extrusion die according to claim 15, wherein the die cavity and preform chamber are integrally formed in a single component.

* * * * *